US006401476B1

(12) United States Patent
Zhu et al.

(10) Patent No.: US 6,401,476 B1
(45) Date of Patent: Jun. 11, 2002

(54) SEPARATION TYPE AIR CONDITIONER AND ITS INSTALLATION METHOD

(75) Inventors: Jianghong Zhu; Jianmin Chen; Hui Zhang; Huimin Qiu; Xiaohui Han, all of Zhuhai (CN)

(73) Assignee: Gree Electric Appliances Inc. of Zhuhai, Guangdong (CN)

( * ) Notice: Subject to any disclaimer, the term of this patent is extended or adjusted under 35 U.S.C. 154(b) by 43 days.

(21) Appl. No.: 09/585,589

(22) Filed: Jun. 2, 2000

(30) Foreign Application Priority Data

Jul. 29, 1999 (CN) ..... 99236765 U

(51) Int. Cl.[7] ..... F25D 23/12
(52) U.S. Cl. ..... 62/262; 62/428
(58) Field of Search ..... 62/262, 428

(56) References Cited

U.S. PATENT DOCUMENTS 3,748,997 A * 7/1973 Dean, Jr. et al. ..... 98/32
3,756,739 A * 9/1973 Riello ..... 62/262
3,805,541 A * 4/1974 Hosoda et al. ..... 62/262
4,971,143 A * 11/1990 Hogan ..... 165/122
4,976,115 A * 12/1990 Hogan ..... 62/428
5,775,125 A * 7/1998 Sakai et al. ..... 62/410
6,182,460 B1 * 2/2001 Hernandez et al. ..... 62/262
6,199,393 B1 * 3/2001 Tesche et al. ..... 62/262
6,216,482 B1 * 4/2001 Xiao et al. ..... 62/262

FOREIGN PATENT DOCUMENTS

CN 98107587.8 10/1998
EP 0 834 704 A2 4/1998

* cited by examiner

*Primary Examiner*—William C. Doerrler
*Assistant Examiner*—Mark S. Shulman

(57) ABSTRACT

The invention discloses a separation type air conditioner and its installation method. The separation type air conditioner comprises an indoor unit, an outdoor unit and a refrigerant tube connecting the indoor unit and the outdoor unit. The indoor unit comprises an evaporator; a centrifugal fan disposed behind the evaporator, the centrifugal fan being placed immediately adjacent to the evaporator; a motor mounted at the center of the centrifugal fan; a water tray disposed below the evaporator; a housing and a panel. The panel abuts against a wall and is operationally connected with the housing when in use; the housing is adapted to be inserted into an opening formed in the wall; the centrifugal fan and motor are installed in said housing, and in a plane parallel to said wall; the size of the panel is larger than that of the portion of the housing to be inserted into the wall opening, and the panel is so sized as to be adapted to cover said wall opening. At the central portion of the panel there is provided an air inlet and at the peripheral portion of the panel there is provided an air outlet.

14 Claims, 4 Drawing Sheets

SEPARATION TYPE AIR CONDITIONER AND ITS INSTALLATION METHOD

FIELD OF THE INVENTION

The invention relates to a separation type air conditioner, and particularly to the indoor unit of the separation type air conditioner and its installation method.

BACKGROUND OF THE INVENTION

The separation type air conditioner now available generally consists of an indoor unit and an outdoor unit, the indoor unit generally comprises such components as an evaporator; a cross flow fan disposed behind the evaporator; a water tray disposed below the evaporator; a panel and control means. The panel is provided with a longitudinally extending air inlet at its central portion in a vertical direction and an air outlet at its the lower edge. With a cross flow fan, such indoor unit has a large volume. When in use, the indoor unit is integrally suspended on an indoor wall and will take up plenty of indoor space due to its larger volume. Afterwards, it is contemplated to replace the cross flow fan with a centrifugal one to reduce the volume of the indoor unit. However, such an indoor unit is also integrally suspended on an indoor wall, and will still take up a relatively large indoor space, as a result the aim to reduce the indoor space taken up by the indoor unit is not achieved. For some applications, particularly in the case that the indoor unit has to be installed at a lower part of an indoor wall, it becomes particularly important to reduce the space taken up by the indoor unit. In addition, these two types of separation type air conditioners are mounted with the refrigerant tube connecting the indoor unit and the outdoor unit being exposed in the room, thus presenting an unpleasant appearance.

SUMMARY OF THE INVENTION

The object of the invention is to provide a separation type air conditioner and its installation method. The construction of the indoor unit in accordance with the invention makes it possible to install the indoor unit in a wall opening formed in the wall, and the refrigerant tube connecting the indoor and the outdoor units may lead to the outdoor unit through the wall opening, thus effectively reducing the space taken up and presenting a beautiful appearance at low cost.

To achieve the above object, there is provided a separation type air conditioner, comprising an indoor unit, an outdoor unit and a refrigerant tube connecting the indoor unit and the outdoor unit; the indoor unit comprising:

an evaporator, a centrifugal fan disposed behind the evaporator, the centrifugal fan being placed immediately adjacent to the evaporator;

a motor mounted at the center of the centrifugal fan;

and a water tray disposed below the evaporator; the indoor unit being composed of a housing and a panel, the panel abutting against a wall and being operationally connected with the housing when in use, the housing being adapted to be inserted into an opening formed in the wall; the centrifugal fan and motor being installed in the housing in a plane parallel to the wall, the size of the panel being larger than that of the portion of the housing to be inserted into the wall opening, and the panel being so sized as to cover the wall opening, and at the central portion of the panel there being provided an air inlet and at the peripheral portion of the panel there being provided an air outlet.

According to another aspect of the invention, there is provided an installation method of a separation type air conditioner, the air conditioner comprising an indoor unit, an outdoor unit and a refrigerant tube connecting the indoor unit and the outdoor unit; the indoor unit comprising:

an evaporator, a centrifugal fan disposed behind the evaporator, the centrifugal fan being placed immediately adjacent to the evaporator;

a motor mounted at the center of the centrifugal fan;

and a water tray disposed below the evaporator;

the method including the steps of: providing an indoor unit, the indoor unit being composed of a housing and a panel,the housing being adapted to be inserted into an opening formed in the wall; the centrifugal fan and motor being installed in the housing in a plane parallel to the wall, the size of the panel being larger than that of the portion of the housing to be inserted into the wall opening, and at the central portion of the panel there being provided an air inlet and at the peripheral portion of the panel there being provided an air outlet;

forming an opening in a wall, the shape of the opening matching with that of the portion of housing to be inserted into the wall opening;

inserting the housing into the opening;

putting the panel on the wall and operationally connecting the panel with the housing to cover the opening.

Preferably, the refrigerant tube connecting the indoor unit and the outdoor unit leads to the outdoor unit through the wall opening.

Preferably, the wall opening is closed on the outdoor side, the outdoor unit is supported by a supporting frame mounted on an outdoor wall.

Preferably, the wall opening is a through hole formed in the wall, the outdoor unit is supported by a supporting structure on the outdoor wall, and the end of the outdoor unit facing indoors is inside the wall opening. A noise and thermal insulating material is provided between the indoor unit and the outdoor unit.

With the separation type air conditioner of the invention, there is no need for a separate installation space, the indoor unit is installed in a wall opening formed in the wall, and looks almost flush with the wall after installation to thereby reduce the indoor space taken up; the refrigerant tube connecting the indoor unit and the outdoor unit leads to the outdoor unit through the wall opening, therefore the refrigerant tube is concealed in the wall body to present a beautiful appearance. A noise and thermal insulating layer can be disposed between the indoor unit and the outdoor unit to isolate the noise generated by the outdoor unit so as to reduce the noise in the room. The implementation of the invention does not require a significant modification of the outdoor unit as to its design and manufacture.

BRIEF DESCRIPTION OF THE ACCOMPANYING DRAWINGS

The preferred embodiments of the invention will be described in detail in connection with accompanying drawings, in which FIG. 1 is a schematic view showing the construction of the first embodiment of the separation type air conditioner in accordance with the invention;

DETAILED DESCRIPTION OF THE PREFERRED EMBODIMENTS

Figure 1:
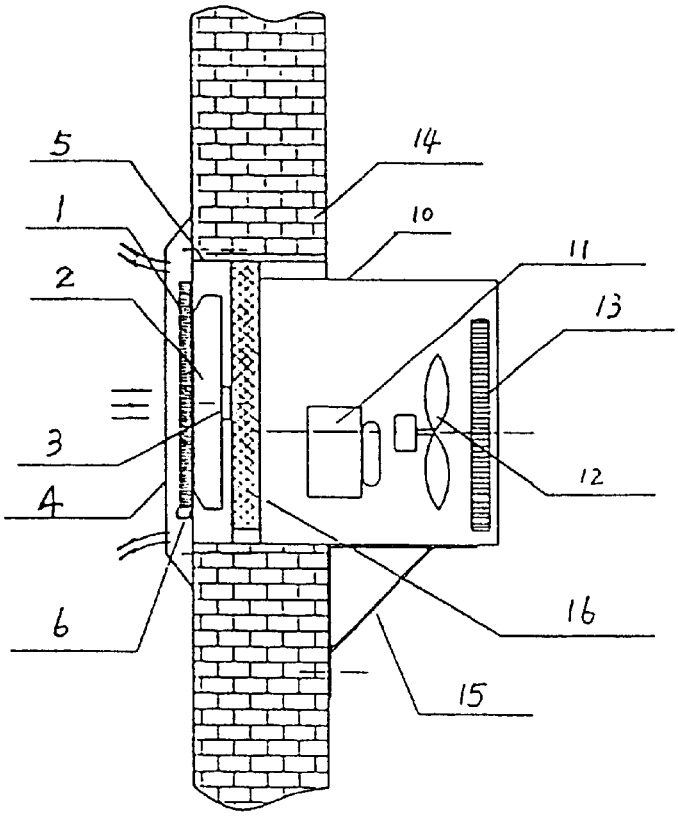

The preferred embodiments of the invention will be described below in connection with accompanying drawings, and like reference numerals represent like components throughout the drawings.

FIG. 1 shows the first embodiment of the separation type air conditioner of the invention. As shown in FIG. 1, the indoor unit of the invention comprises an evaporator 1; a centrifuigal fan 2 positioned behind the evaporator; a motor 3 mounted at the center of the centrifugal fan 2; a water tray 6 disposed below the evaporator; a panel 4 and a housing 5. The centrifugal fan 2 is disposed immediately adjacent to the evaporator 1, at the central portion of the panel 4 there is formed an air inlet, and at the peripheral portion of the panel there are formed air outlets. The centrifugal fan 2 and the motor 3 are installed in the housing 5, and the housing 5 is connected with the panel 4. The indoor unit can be easily mounted in an opening in an indoor wall, and the main components of the indoor unit are positioned in a space defined by the thickness of the wall.

The outdoor unit typically includes a casing 10, a compressor 11, an axial flow fan 12, a condenser 13, valves, electric control means and pipes.

Figure 2:
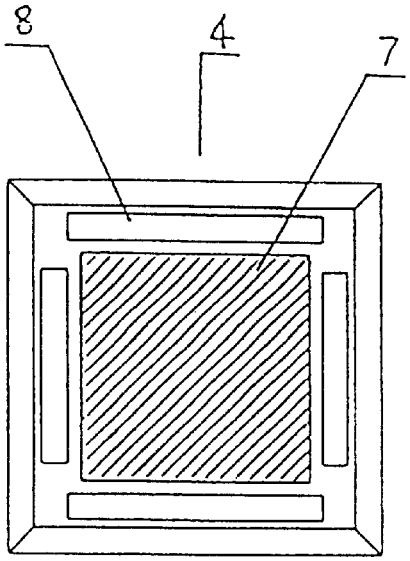
FIG. 2 is a schematic view showing the construction of the panel of the indoor unit of the separation type air conditioner in accordance with the invention.

FIG. 2 shows the construction of the panel of the indoor unit of the separation type air conditioner in accordance with the invention. As shown in FIG. 2, the panel 4 is square in shape, at its central portion there is provided an air inlet 7 and at its peripheral portion there are provided all together four air outlets 8.

Figure 3:
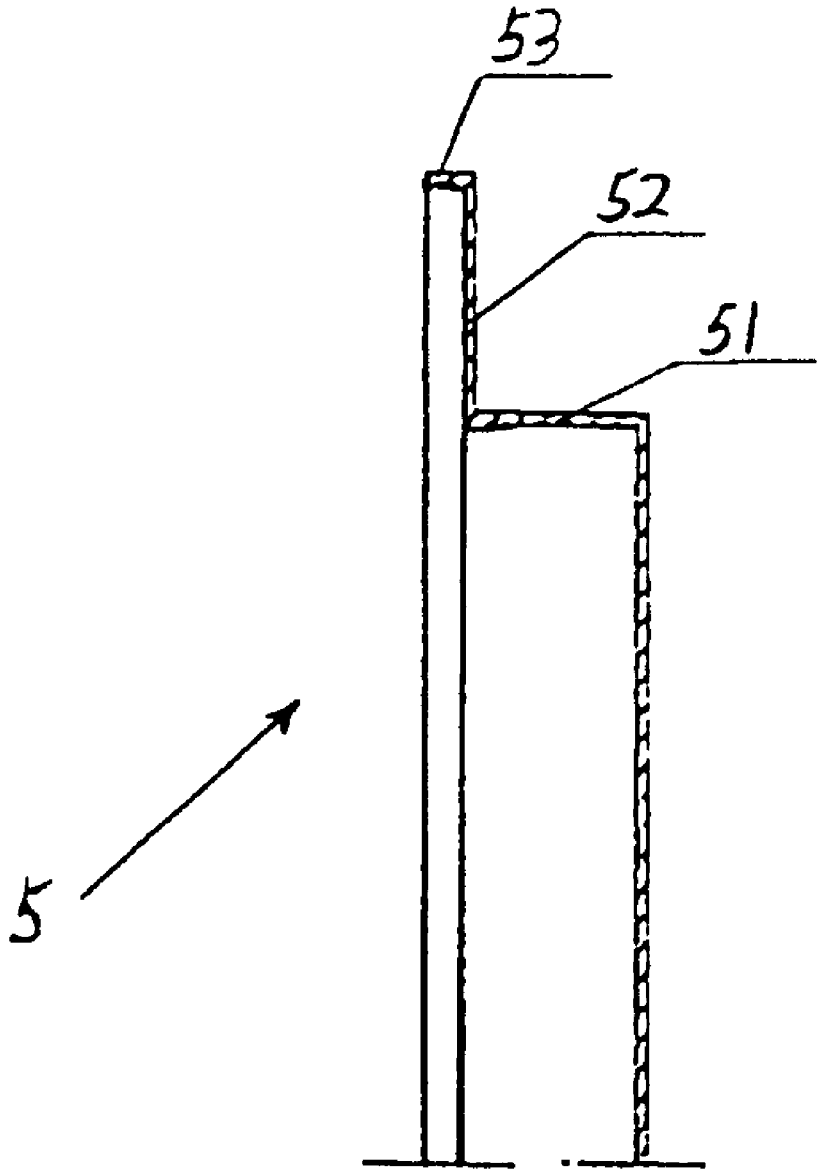
FIG. 3 is a sectional view of the housing of the indoor unit of the separation type air conditioner in accordance with the invention.

FIG. 3 is a sectional view of the housing of the indoor unit of the separation type air conditioner in accordance with the invention. As shown in FIG. 3, the housing 5 comprises a portion 51 adapted to be inserted to the wall opening and a flange 52 adapted to abut against the indoor wall. The housing 5 can be attached to the wall through the flange 52 by means of expansion bolts or fixed in the wall opening. The housing flange 52 further comprises a right-angled fitting plate 53 at its edge. The panel 4 has a corresponding fitting plate at its periphery, which is fitted over the fitting plate of the housing and is fixed by means of screws when the panel is fitted to the housing 5.

Figure 4:
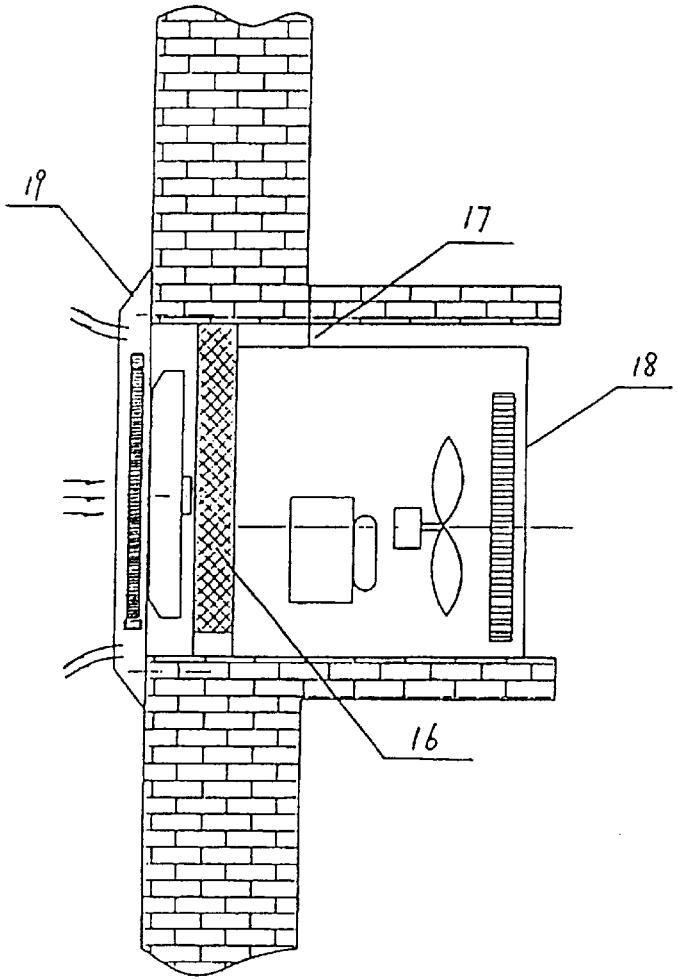
FIG. 4 is a schematic view showing the construction of the second embodiment of the separation type air conditioner in accordance with the invention.

The installation of the first embodiment of the separation type air conditioner of the invention is now described with reference to FIG. 1. The indoor and outdoor units of the air conditioner are installed on the wall body 14. When installing the air conditioner, the outdoor unit can first be mounted on a supporting frame 15 or support of other types which are mounted on the outdoor wall, and the end of the outdoor unit facing indoors is placed in a wall opening; then the indoor and outdoor units are connected by a refrigerant tube; thereafter, the housing of indoor unit, which contains the evaporator 1, the centrifugal fan 2, the motor 3 and the water tray 6, is inserted into the opening formed in the wall and the refrigerant tube is placed in the wall opening; the housing 5 of indoor unit can be attached to the wall by means of expansion bolts or fixed in the wall opening with its flange abutting against the indoor wall; and then the panel 4 of the indoor unit is pressed against the wall and is connected to the housing 5 by means of bolts or snapper. Preferably, as shown in FIGS. 1, 3 and 4, the area of the panel 4 is larger than the area of the cross section of the portion of housing 5 which is inserted into the wall opening. The wall opening is covered over by the panel 4 completely, and the main components of the indoor unit are located inside the wall opening. A noise and thermal insulating layer 16 can be disposed between the indoor unit and the outdoor unit to isolate the noise generated by the outdoor unit and heat. The noise and thermal insulating layer 16 is made of a laminated board of general noise and thermal insulating materials.

FIG. 4 shows the installation arrangement of the second embodiment of the separation type air conditioner in accordance with the invention. As shown in FIG. 4, there is a ready installation opening 17 in the wall of an existing building, the outdoor unit 18 is placed in the opening 17 and is supported by a supporting structure provided on the outdoor wall, and the indoor unit 19 is mounted in the way shown in FIG. 1. Between the outdoor unit 18 and the indoor unit 19 there is disposed a noise and thermal insulating layer 16.

Figure 5:
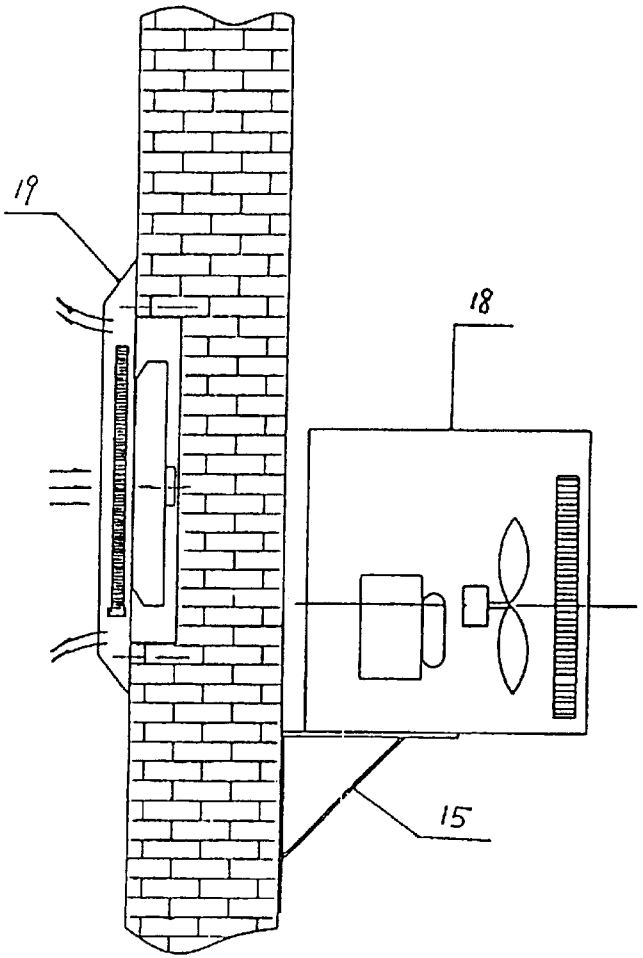
FIG. 5 is a schematic view showing the construction of the third embodiment of the separation type air conditioner in accordance with the invention.

FIG. 5 shows an installation arrangement of the third embodiment of the separation type air conditioner in accordance with the invention. As shown in FIG. 5, the indoor unit 19 is inserted into a cavity in the wall which is closed outside in the way shown in FIG. 1, and the outdoor unit 18 is supported by a supporting frame 15 fixed to the outdoor wall, and the refrigerant tube passes through the wall to be connected with the indoor unit 19 located in the wall cavity. With this installation arrangement, since the wall cavity is closed on the outdoor side and the outdoor unit 18 is supported by the supporting frame 15 on the outdoor wall, there is no need for disposition of the above-described noise and thermal insulating layer.

Figures 6, 7:
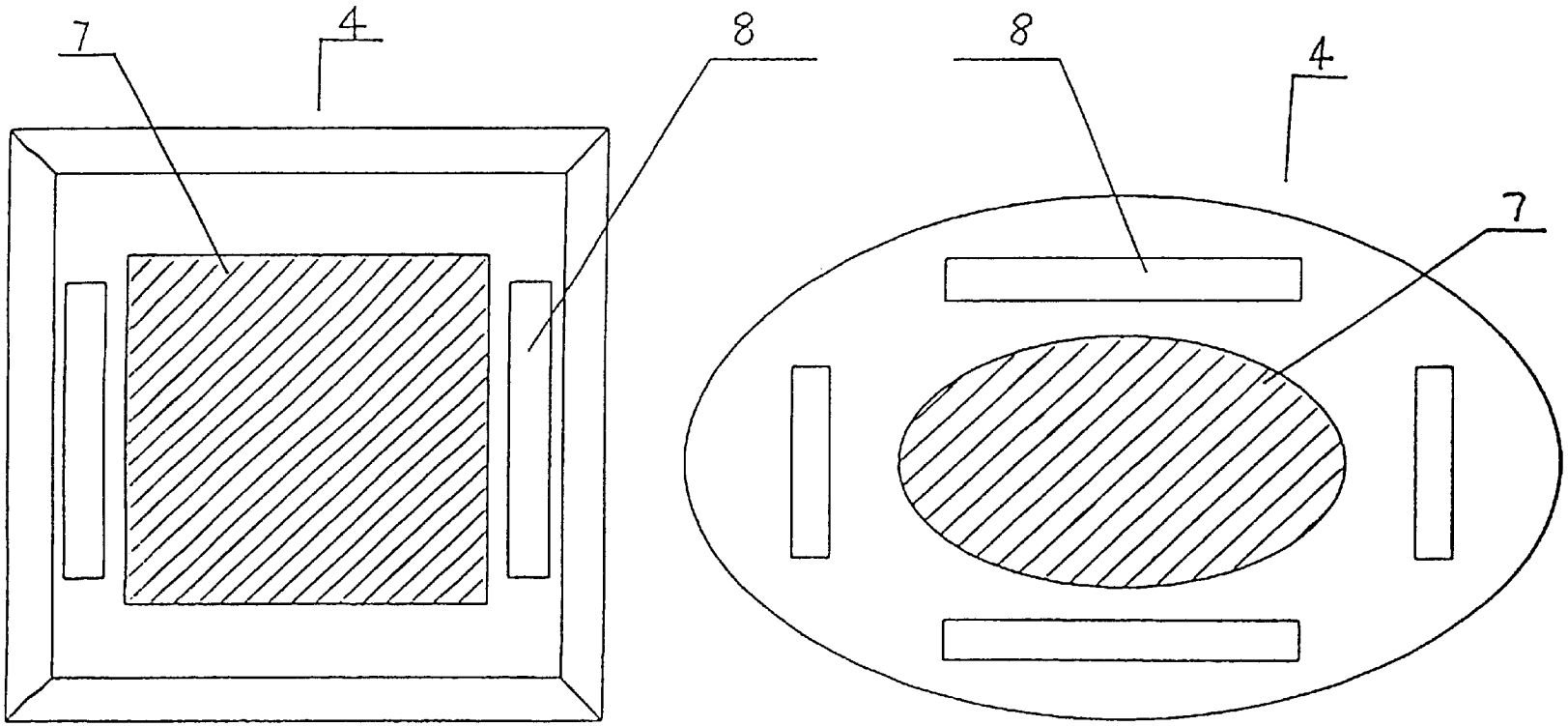
FIG. 6 shows another alternative construction of die panel of the indoor unit of the separation type air conditioner in accordance with the invention.
FIG. 7 shows still another alternative construction of the panel of the indoor unit of the separation type air conditioner in accordance with the invention.

FIG. 6 shows another constriction of the panel of the separation type air conditioner in accordance with the invention. As shown in FIG. 6, the panel 4 is square in shape, at its central portion there is formed an inlet 7, and at its peripheral portion there are provided two air outlets 8, one is on the left and the other is on the right.

FIG. 7 shows still another construction of the panel of the separation type air conditioner in accordance with the invention. As shown in FIG. 7, the panel 4 is elliptical in shape, at its central portion there is provided an air inlet 7, and at its peripheral portion there are provided all together four air outlets 8.

The invention has been described above in connection with the preferred embodiments, the persons skilled in the art will appreciate that the embodiments of the invention are not limited to above examples and various modifications can be made within the scope of the invention. For example, at the peripheral portion of the panel there can be formed one, two, three or four air outlets as required; the panel 4 can be directly mounted on the wall to be fixed; the way of fixing the housing 5 into the wall opening or to the wall is not limited to that described above, various other ways can be used to fix the housing 5 into the wall opening and/or to the wall.

What is claimed is:

1. A separation type air conditioner, comprising an indoor unit and an outdoor unit, the indoor unit and the outdoor unit being structurally separate units which, when in use, are connected with each other through a refrigerant tube, said indoor unit comprising:

an outer casing, said outer casing comprising a housing and a panel;

an evaporator;

a centrifugal fan disposed directly behind the evaporator, said centrifugal fan being placed immediately adjacent to the evaporator so as to reduce the thickness of the indoor unit;

a motor mounted at the center of the centrifugal fan; and a water tray disposed below the evaporator;

said panel abutting against a wall and being operationally connected with the housing when in use, said housing being adapted to be inserted into an opening formed in the wall; said centrifugal fan and motor being installed in said housing, the size of said panel being larger than that of the portion of the housing to be inserted into the wall opening in a plane parallel to said wall, and the panel being so sized as to be adapted to cover said wall opening, and at the central portion of said panel there being provided an air inlet and at the peripheral portion of the panel there being provided an air outlet.

2. The separation type air conditioner as claimed in claim 1, wherein said panel is rectangular in shape, at the central portion thereof there is provided an air inlet, and at the peripheral portion thereof there are provided two air outlets which are opposite to each other.

3. The separation type air conditioner as claimed in claim 1, wherein said panel is rectangular in shape, at the central portion thereof there is provided an air inlet, and at the peripheral portion there are provided four air outlets.

4. The separation type air conditioner as claimed in claim 1, wherein said panel is elliptical in shape, at the central portion thereof there is provided an air inlet, and at the peripheral portion there are provided four air outlets.

5. An installation method for a separation type air conditioner, said air conditioner comprising an indoor unit and an outdoor unit, the indoor unit and the outdoor unit being structurally separate units which, when in use, are connected with each other through a refrigerant tube, said indoor unit comprising:

an outer casing, said outer casing comprising a housing and a panel;

an evaporator;

a centrifugal fan disposed directly behind the evaporator, said centrifugal fan being placed immediately adjacent to the evaporator so as to reduce the thickness of the indoor unit;

a motor mounted at the center of the centrifugal fan; and a water tray disposed below the evaporator;

said centrifugal fan and motor being installed in said housing, the size of said panel being larger than the size of the housing, and at the central portion of said panel there being provided an air inlet and at the peripheral portion of the panel there being provided an air outlet;

said method comprising the steps of:

forming an opening in the wall, the shape of the opening substantially matching the shape of the housing;

inserting the housing into said opening; and then operationally connecting the panel to said housing, said panel thereby abutting against said wall in a manner so as to cover said opening.

6. The installation method as claimed in claim 5, wherein the refrigerant tube connecting the indoor unit and the outdoor unit leads to the outdoor unit through the wall opening.

7. The installation method as claimed in claim 5, wherein said wall opening is closed on the outdoor side, said outdoor unit is supported by a supporting frame mounted on an outdoor wall.

8. The installation method as claimed in claim 5, wherein said wall opening is a through hole formed in the wall, said outdoor unit is supported by a supporting structure on the outdoor wall, and the end of said outdoor unit facing indoors is inside the wall opening.

9. The installation method as claimed in claim 8, wherein between the indoor unit and the outdoor unit there is disposed noise and thermal insulating material.

10. The installation method as claimed in claim 5, wherein said panel is rectangular in shape, at the central portion thereof there is provided an air inlet, and at the peripheral portion thereof there are provided two air outlets which are opposite to each other.

11. The installation method as claimed in claim 5, wherein said panel is rectangular in shape, at the central portion thereof there is provided an air inlet, and at the peripheral portion there are provided four air outlets.

12. The installation method as claimed in claim 5, wherein said panel is elliptical in shape, at the central portion thereof there is provided an air inlet, and at the peripheral portion there are provided four air outlets.

13. A separation type air conditioner mounted to a wall, the separation type air conditioner comprising an indoor unit and an outdoor unit, said indoor and outdoor units being structurally separate and being connected by a refrigerant tube, said indoor unit comprising:

a housing containing operative components of said indoor unit, said housing and said operative components being disposed substantially entirely within an opening in the wall; and a panel attached to said housing and covering said opening such that said opening is not visible from an indoor side of the wall.

14. A separation type air conditioner as claimed in claim 13 wherein said operative components comprise an evaporator, a fan and a motor.

* * * * *